US009168426B2

(12) United States Patent
Solheim et al.

(10) Patent No.: US 9,168,426 B2
(45) Date of Patent: Oct. 27, 2015

(54) GOLF CLUBS WITH HOSEL INSERTS AND METHODS OF MANUFACTURING GOLF CLUBS WITH HOSEL INSERTS

(71) Applicant: KARSTEN MANUFACTURING CORPORATION, Phoenix, AZ (US)

(72) Inventors: John A. Solheim, Phoenix, AZ (US); Eric V. Cole, Phoenix, AZ (US); Jeffrey A. Blankenship, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 13/795,653

(22) Filed: Mar. 12, 2013

(65) Prior Publication Data

US 2014/0274444 A1 Sep. 18, 2014

(51) Int. Cl.
*A63B 53/02* (2006.01)
*A63B 53/04* (2015.01)

(52) U.S. Cl.
CPC ..... *A63B 53/02* (2013.01); *A63B 53/0466* (2013.01); *A63B 2053/045* (2013.01); *A63B 2209/00* (2013.01); *Y10T 29/49826* (2015.01)

(58) Field of Classification Search
CPC ..... A63B 53/02; A63B 53/0466; A63B 2209/00; A63B 2053/045; Y10T 29/49826
USPC ..... 473/305, 307, 308, 309, 310, 312, 345, 473/346
See application file for complete search history.

(56) References Cited

U.S. PATENT DOCUMENTS

| | | | |
|---|---|---|---|
| 1,540,559 | A | 6/1925 | Murphy |
| 1,610,802 | A | 12/1926 | McNair |
| 1,623,523 | A | 4/1927 | Bourke |
| 1,665,811 | A | 4/1928 | Hadden |
| 1,918,583 | A | 7/1933 | Bear |
| 2,027,452 | A | 1/1936 | Rusing |
| 2,051,961 | A | 8/1936 | Mears |
| 2,067,556 | A | 1/1937 | Wettlaaufer |
| 2,175,598 | A | 10/1939 | Fedak |
| 2,219,670 | A | 10/1940 | Wettlaaufer |
| 2,425,808 | A | 8/1947 | Jakosky |
| 2,644,689 | A | 7/1953 | Putnam |
| 2,962,286 | A | 11/1960 | Brouwer |
| 3,170,691 | A | 2/1965 | Pritchard |
| 3,176,987 | A | 4/1965 | Johnston |
| 3,206,206 | A | 9/1965 | Santosuosso |
| 3,524,646 | A | 8/1970 | Wheeler |
| 3,601,399 | A | 8/1971 | Agens et al. |
| 3,625,513 | A | 12/1971 | Ballmer |
| 3,685,135 | A | 8/1972 | Letters |
| 3,840,231 | A | 10/1974 | Moore |
| 3,907,446 | A | 9/1975 | Leslie |
| 4,664,382 | A | 5/1987 | Palmer et al. |
| 4,815,740 | A | 3/1989 | Williams et al. |
| 4,852,782 | A | 8/1989 | Wu et al. |
| 4,854,582 | A | 8/1989 | Yamada |
| 4,892,316 | A | 1/1990 | Langert et al. |

(Continued)

FOREIGN PATENT DOCUMENTS

| | | | |
|---|---|---|---|
| EP | 0535848 | A1 | 4/1993 |
| GB | 2241173 | A | 8/1991 |

(Continued)

*Primary Examiner* — Stephen Blau

(57) ABSTRACT

Embodiments of golf club heads with hosel inserts are presented herein. Other embodiments can be described and claimed.

24 Claims, 5 Drawing Sheets

(56) References Cited

U.S. PATENT DOCUMENTS 4,943,059 A 7/1990 Morell
4,948,132 A 8/1990 Wharton
4,995,609 A 2/1991 Parente et al.
5,039,098 A 8/1991 Pelz
5,042,806 A 8/1991 Helmstetter
5,067,711 A 11/1991 Parente et al.
5,149,091 A 9/1992 Okumoto et al.
5,165,688 A 11/1992 Schmidt et al.
5,222,734 A 6/1993 Parente et al.
5,273,280 A 12/1993 Lo
5,275,399 A 1/1994 Schmidt et al.
5,320,347 A 6/1994 Parente et al.
5,324,033 A 6/1994 Fenton, Jr.
5,395,109 A 3/1995 Fenton, Jr.
5,429,355 A 7/1995 Schmidt et al.
5,433,442 A 7/1995 Walker
5,441,274 A 8/1995 Clay
5,538,245 A 7/1996 Moore
D375,130 S 10/1996 Hlinka et al.
D378,770 S 4/1997 Hlinka et al.
5,632,695 A * 5/1997 Hlinka et al. ..... 473/341
5,647,807 A 7/1997 Nagamoto
5,722,901 A 3/1998 Barron et al.
D393,678 S 4/1998 Jones et al.
5,839,973 A 11/1998 Jackson
5,863,260 A 1/1999 Butler, Jr. et al.
5,924,938 A 7/1999 Hines
5,951,411 A 9/1999 Wood et al.
6,050,903 A 4/2000 Lake
6,152,833 A * 11/2000 Werner et al. ..... 473/324
D434,822 S 12/2000 Jacobson et al.
D449,665 S 10/2001 Etherton et al.
6,319,148 B1 11/2001 Tom
6,352,482 B1 3/2002 Jacobson et al.
6,547,673 B2 4/2003 Roark
6,669,576 B1 * 12/2003 Rice ..... 473/305
6,716,114 B2 4/2004 Nishio
6,857,969 B2 2/2005 Rice
6,863,622 B1 3/2005 Hsu
6,887,163 B2 5/2005 Blankenship
6,890,269 B2 5/2005 Burrow
7,083,529 B2 8/2006 Cackett et al.
7,117,923 B2 10/2006 Schweigert
D537,896 S 3/2007 Holt et al.
7,300,359 B2 11/2007 Hocknell et al.
7,326,126 B2 2/2008 Holt et al.
7,344,449 B2 3/2008 Hocknell et al.
7,351,159 B2 4/2008 Lai
7,438,645 B2 10/2008 Hsu
D582,999 S 12/2008 Evans et al.
D583,000 S 12/2008 Evans et al.
D583,001 S 12/2008 Evans et al.
D583,002 S 12/2008 Evans et al.
D583,890 S 12/2008 DeMille et al.
D583,891 S 12/2008 DeMille et al.
7,465,239 B2 12/2008 Hocknell et al.
D586,417 S 2/2009 Hall et al.
D587,770 S 3/2009 Evans et al.
D588,219 S 3/2009 Evans et al.
D588,660 S 3/2009 Evans et al.
D588,663 S 3/2009 Lee
D589,577 S 3/2009 Evans et al.
D590,036 S 4/2009 Evans et al.
D590,466 S 4/2009 Hall et al.
D590,467 S 4/2009 Cackett et al.
D590,468 S 4/2009 Evans et al.
D590,904 S 4/2009 Evans et al.
D590,905 S 4/2009 DeMille et al.
D590,906 S 4/2009 Cackett et al.
D591,375 S 4/2009 Evans et al.
D591,376 S 4/2009 Evans et al.
D591,377 S 4/2009 Evans et al.
D591,378 S 4/2009 Hocknell et al.
D591,380 S 4/2009 Evans et al.
7,530,900 B2 5/2009 Holt et al.
7,553,240 B2 6/2009 Burnett et al.
7,566,279 B2 7/2009 Nakashima
7,578,749 B2 8/2009 Hocknell et al.
7,601,075 B2 10/2009 Cole et al.
D614,712 S 4/2010 Toulon et al.
7,699,717 B2 4/2010 Morris et al.
7,722,475 B2 5/2010 Thomas et al.
7,762,906 B2 * 7/2010 Murphy et al. ..... 473/309
7,846,037 B2 12/2010 Burnett et al.
7,874,934 B2 1/2011 Soracco et al.
7,878,921 B2 2/2011 Bennett et al.
7,909,706 B2 3/2011 Cole
7,922,599 B2 4/2011 Yamamoto
7,931,542 B2 4/2011 Kusumoto
7,955,182 B2 6/2011 Thomas et al.
7,963,855 B2 6/2011 Sander et al.
7,980,959 B2 7/2011 Morris et al.
7,997,997 B2 8/2011 Bennett et al.
8,025,587 B2 9/2011 Beach et al.
8,057,320 B2 11/2011 Bennett et al.
8,079,918 B2 12/2011 Cole
8,088,019 B1 1/2012 Long et al.
8,096,894 B2 1/2012 Sander
8,133,131 B1 3/2012 Bennett et al.
8,142,306 B2 3/2012 De La Cruz et al.
8,147,350 B2 4/2012 Beach et al.
8,147,351 B2 4/2012 Bennett et al.
8,177,661 B2 5/2012 Beach et al.
8,207,507 B2 6/2012 Zaitseva et al.
8,216,084 B2 7/2012 Bennett et al.
8,231,480 B2 7/2012 Thomas et al.
8,235,834 B2 8/2012 De La Cruz et al.
8,235,837 B2 8/2012 Bennett et al.
8,262,498 B2 9/2012 Beach et al.
8,277,333 B2 10/2012 Thomas et al.
8,303,431 B2 11/2012 Beach et al.
8,403,770 B1 3/2013 Aguinaldo et al.
8,419,567 B2 4/2013 Jertson et al.
8,496,541 B2 7/2013 Beach et al.
8,523,701 B2 9/2013 Knutson et al.
8,535,173 B2 9/2013 Golden et al.
8,602,907 B2 12/2013 Beach et al.
8,616,995 B2 12/2013 Thomas et al.
8,622,847 B2 1/2014 Beach et al.
8,636,606 B2 1/2014 Sato
8,696,487 B2 4/2014 Beach et al.
2001/0007835 A1 7/2001 Baron
2005/0059508 A1 3/2005 Burnett et al.
2005/0101402 A1 5/2005 Kawakami
2005/0239576 A1 10/2005 Stites et al.
2005/0282653 A1 12/2005 Murphy et al.
2006/0281575 A1 12/2006 Hocknell et al.
2006/0287125 A1 12/2006 Hocknell et al.
2006/0293115 A1 12/2006 Hocknell et al.
2006/0293116 A1 12/2006 Hocknell et al.
2007/0117645 A1 5/2007 Nakashima
2008/0058114 A1 3/2008 Hocknell et al.
2008/0254909 A1 10/2008 Callinan et al.
2008/0261716 A1 10/2008 Sugimoto
2008/0280693 A1 11/2008 Chai
2008/0293510 A1 * 11/2008 Yamamoto ..... 473/308
2009/0062029 A1 3/2009 Stites et al.
2009/0075749 A1 3/2009 De La Cruz et al.
2009/0124407 A1 5/2009 Hocknell et al.
2009/0197698 A1 8/2009 Morris et al.
2009/0233728 A1 9/2009 Liou
2009/0247316 A1 10/2009 De La Cruz et al.
2009/0264214 A1 10/2009 De La Cruz et al.
2009/0275423 A1 11/2009 Yamamoto
2009/0286611 A1 11/2009 Beach et al.
2009/0286618 A1 11/2009 Beach et al.
2009/0286619 A1 11/2009 Beach et al.
2010/0016094 A1 1/2010 Hocknell et al.
2010/0016096 A1 1/2010 Burnett et al.
2010/0035700 A1 2/2010 Yu et al.
2010/0035701 A1 2/2010 Kusmoto
2010/0041491 A1 2/2010 Thomas et al.
2010/0120550 A1 5/2010 Galloway
2010/0120552 A1 5/2010 Sander et al.

(56) References Cited

U.S. PATENT DOCUMENTS

| | | | | |
|---|---|---|---|---|
| 2010/0144459 | A1 | 6/2010 | Sato et al. | |
| 2010/0197423 | A1 | 8/2010 | Thomas et al. | |
| 2010/0197424 | A1 | 8/2010 | Beach et al. | |
| 2010/0203981 | A1 | 8/2010 | Morris et al. | |
| 2010/0234136 | A1* | 9/2010 | Nishitani | 473/345 |
| 2010/0261543 | A1 | 10/2010 | Breier et al. | |
| 2010/0323808 | A1 | 12/2010 | Sato et al. | |
| 2010/0323809 | A1* | 12/2010 | Murphy | 473/314 |
| 2010/0331121 | A1 | 12/2010 | Morris et al. | |
| 2011/0009206 | A1 | 1/2011 | Soracco | |
| 2011/0021282 | A1 | 1/2011 | Sander | |
| 2011/0098127 | A1 | 4/2011 | Yamamoto | |
| 2011/0105242 | A1 | 5/2011 | Beach et al. | |
| 2011/0111881 | A1 | 5/2011 | Sander et al. | |
| 2011/0118044 | A1 | 5/2011 | Sato et al. | |
| 2011/0118045 | A1 | 5/2011 | Sato et al. | |
| 2011/0118048 | A1 | 5/2011 | Soracco | |
| 2011/0118051 | A1 | 5/2011 | Thomas | |
| 2011/0143854 | A1 | 6/2011 | Bennett et al. | |
| 2011/0152000 | A1 | 6/2011 | Sargent et al. | |
| 2011/0159983 | A1* | 6/2011 | Burnett et al. | 473/307 |
| 2011/0177876 | A1 | 7/2011 | Bennett et al. | |
| 2011/0190072 | A1 | 8/2011 | Beach et al. | |
| 2011/0195798 | A1 | 8/2011 | Sander et al. | |
| 2011/0201447 | A1 | 8/2011 | Thomas et al. | |
| 2011/0207547 | A1 | 8/2011 | Sander et al. | |
| 2011/0250984 | A1 | 10/2011 | Sato | |
| 2011/0275448 | A1 | 11/2011 | Morris et al. | |
| 2011/0287853 | A1* | 11/2011 | Sato | 473/307 |
| 2011/0312437 | A1 | 12/2011 | Sargent et al. | |
| 2011/0319185 | A1* | 12/2011 | Beach et al. | 473/288 |
| 2012/0010015 | A1 | 1/2012 | Bennett et al. | |
| 2012/0034994 | A1 | 2/2012 | Knutson et al. | |
| 2012/0034995 | A1 | 2/2012 | Harvell et al. | |
| 2012/0034996 | A1 | 2/2012 | Murphy et al. | |
| 2012/0071261 | A1 | 3/2012 | Yamamoto | |
| 2012/0100926 | A1 | 4/2012 | Golden et al. | |
| 2012/0165111 | A1 | 6/2012 | Cheng | |
| 2012/0165112 | A1 | 6/2012 | Bennett et al. | |
| 2012/0225731 | A1 | 9/2012 | Suwa et al. | |
| 2012/0316006 | A1 | 12/2012 | Kitagawa et al. | |
| 2013/0053164 | A1 | 2/2013 | Jertson | |
| 2013/0053167 | A1 | 2/2013 | Jertson | |
| 2013/0085010 | A1 | 4/2013 | Beach et al. | |
| 2013/0296069 | A1 | 11/2013 | Beach et al. | |
| 2013/0324285 | A1 | 12/2013 | Beach et al. | |
| 2014/0066223 | A1 | 3/2014 | Beach et al. | |
| 2014/0080617 | A1 | 3/2014 | Llewellyn et al. | |
| 2014/0106900 | A1 | 4/2014 | Beach et al. | |
| 2014/0113740 | A1 | 4/2014 | Stites et al. | |

FOREIGN PATENT DOCUMENTS

| | | | | |
|---|---|---|---|---|
| GB | 2268693 | A | * | 1/1994 |
| GB | 2363340 | A | | 12/2001 |
| GB | 2387550 | A | | 10/2003 |
| JP | 10-263121 | | * | 10/1998 |
| JP | 2001017584 | A | | 1/2001 |
| JP | 2003070940 | A | | 3/2003 |
| JP | 2006042951 | | | 2/2006 |
| JP | 2008142338 | A | * | 6/2008 |
| JP | 2009050676 | A | | 3/2009 |
| JP | 3154639 | | | 10/2009 |
| KR | 20070021382 | A | | 2/2007 |
| WO | 8803427 | | | 5/1988 |
| WO | 2007021160 | | | 2/2007 |
| WO | WO2009035345 | A1 | | 3/2009 |
| WO | WO2010039658 | A2 | | 4/2010 |
| WO | WO2011048969 | A1 | | 4/2011 |

* cited by examiner

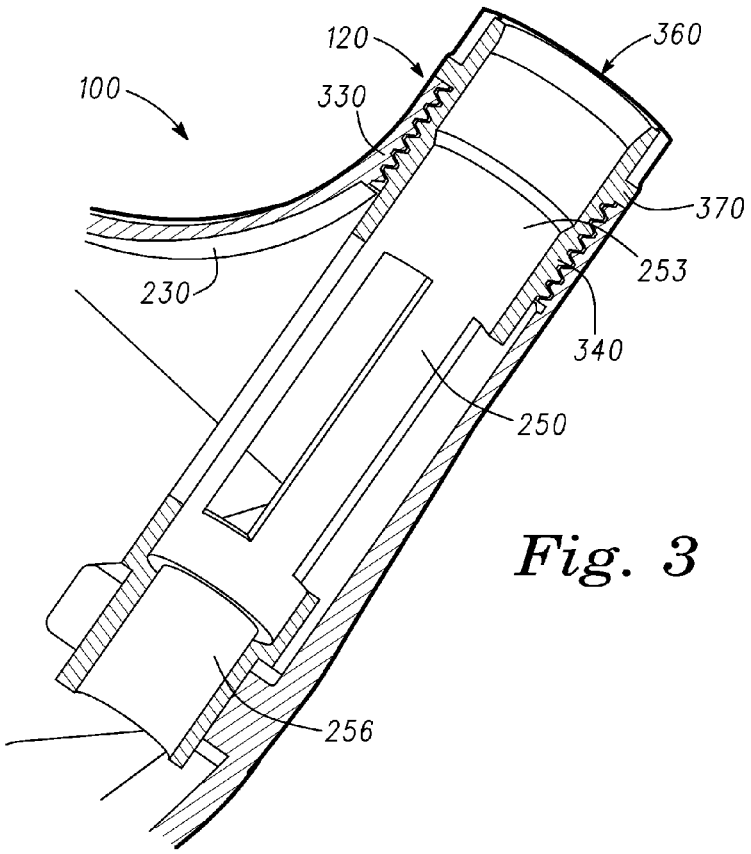
Fig. 3
Fig. 4
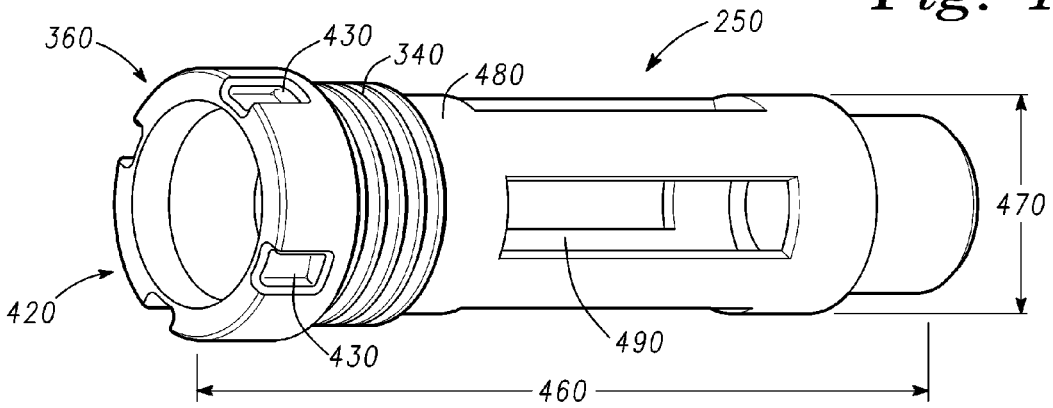

GOLF CLUBS WITH HOSEL INSERTS AND METHODS OF MANUFACTURING GOLF CLUBS WITH HOSEL INSERTS

TECHNICAL FIELD

The present disclosure relates generally to golf equipment, and more particularly, to golf clubs with hosel inserts and methods of manufacturing golf clubs with hosel inserts.

BACKGROUND

Golf club heads have been progressively growing in volume and size throughout the years in an effort to improve the game experience. As the golf club heads have grown in volume, the mass of the golf clubs has also increased. Innovation in mass distribution has been a major focus of the golf industry, and utilizing various materials to achieve desirable characteristics has become increasingly common.

A golf club head's design can optimize the golf club head's mass distribution scheme by, for example, using less dense materials in certain areas and more dense materials in other areas. Such designs can facilitate a larger golf club head without compromising performance.

BRIEF DESCRIPTION OF THE DRAWINGS

The present disclosure can be better understood from a reading of the following detailed description of examples of embodiments, taken in conjunction with the accompanying figures.

FIG. 3 is a cross sectional view of a hosel region of the golf club head of FIG. 1.

FIG. 4 is a side view of a hosel insert according to the embodiment of FIG. 2.

Figure 1:
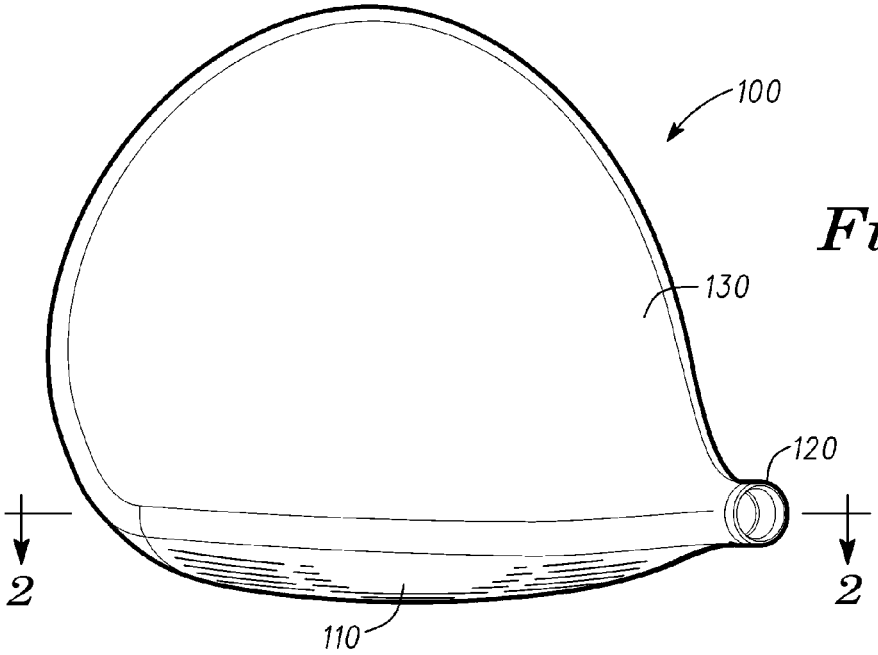
FIG. 1 is a top view of a golf club head according to one embodiment of the apparatus, methods and articles of manufacture described herein.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements, mechanically or otherwise. Coupling (whether mechanical or otherwise) may be for any length of time, e.g., permanent or semi-permanent or only for an instant.

The absence of the word "removably," "removable," and the like near the word "coupled," and the like does not mean that the coupling, etc. in question is or is not removable.

As defined herein, two or more elements are "integral" if they are comprised of the same piece of material. As defined herein, two or more elements are "non-integral" if each is comprised of a different piece of material.

Description

In one example, a golf club can comprise golf club head with a strike face and a hole. The golf club head can comprise a first material that has a first density. A hosel insert can be located within the hole and the hosel insert can comprise a second material having a second density. The second material can be different from the first material, and the second density can be less than the first density. A shaft can have a shaft tip that can be located within a portion of the hosel insert.

In another example, a golf club head can comprise a hollow body made of a first material. The golf club head can have a strike face, and a crown that is coupled to the strike face comprising a crown hole that opens into the interior of the hollow body. The golf club also has a sole coupled to the strike face, an interior surface. The interior surface forms an outer boundary of the interior of the hollow body. The golf club head also has a support structure that is coupled to the interior surface and aligned with the crown hole. A hosel comprising a first hosel portion configured to house a shaft tip, and a second hosel portion adjacent to the first hosel portion. Wherein the first hosel portion engages the crown hole, and the second hosel portion engages the support structure. The hosel comprising a second material different form the first material.

In a further example, a method for providing a golf club including providing a golf club head comprising a strike face and a hole. The golf club head comprising a first material having a first density. Positioning a hosel insert within the hole and comprising a second material have a second density. The second material different form the first material, and the second density different from the first density. Positioning a shaft within a portion of the hosel insert.

Other examples and embodiments are further disclosed herein. Such examples and embodiments are found in the following paragraphs, the figures, and the claims.

FIG. 1 shows a golf club head 100 according to an embodiment. Golf club head 100 is merely exemplary and is not limited to the embodiments presented herein. Golf club head 100 can be employed in many different embodiments or examples not specifically depicted or described herein.

Golf club head 100 is comprised of a strike face 110, a hole 120, and a crown portion 130. Strike face 110 can be configured for striking a golf ball (not shown) and can comprise titanium, steel, aluminum or any other suitable material. Hole 120 can have any shape or diameter. For example, hole 120 can have a generally closed, circular shape with a diameter between approximately 0.25 inches (0.64 centimeters (cm)) and approximately 0.75 inches (1.91 cm). In other embodiments, hole 120 can have a diameter between approximately 0.4 inches (1.0 cm) and approximately 0.6 inches (1.52 cm). In further embodiments, hole 120 can have a partially open circular periphery or any non-circular closed or partially open periphery.

While FIG. 1 depicts hole 120 as being located in crown portion 130 of golf club head 100, hole 120 can be located anywhere on golf club head 100. Further, while FIG. 1 depicts a wood-style golf club head, golf club head 100 can be any one of an iron-style, putter-style, hybrid-style, or wedge-style golf club head.

Golf club head 100 can be manufactured out of any material known in the art. For example titanium, aluminum, various metallic alloys, steel, composites, plastics, wood, or any other sturdy material can make up the majority of golf club head 100. The material used for golf club head 100 has a density value. For example, if golf club head 100 is made of titanium, the titanium can have a density of approximately 4.51 grams per centimeter-cubed (g/cm$^3$) near room temperature, and if golf club head 100 is made of aluminum, the aluminum can have a density of approximately 2.7 g/cm$^3$ near room temperature. In other embodiments, the density of materials used for golf club head 100 can be between approximately 2.6 g/cm$^3$ and approximately 7.8 g/cm$^3$.

Figure 2:
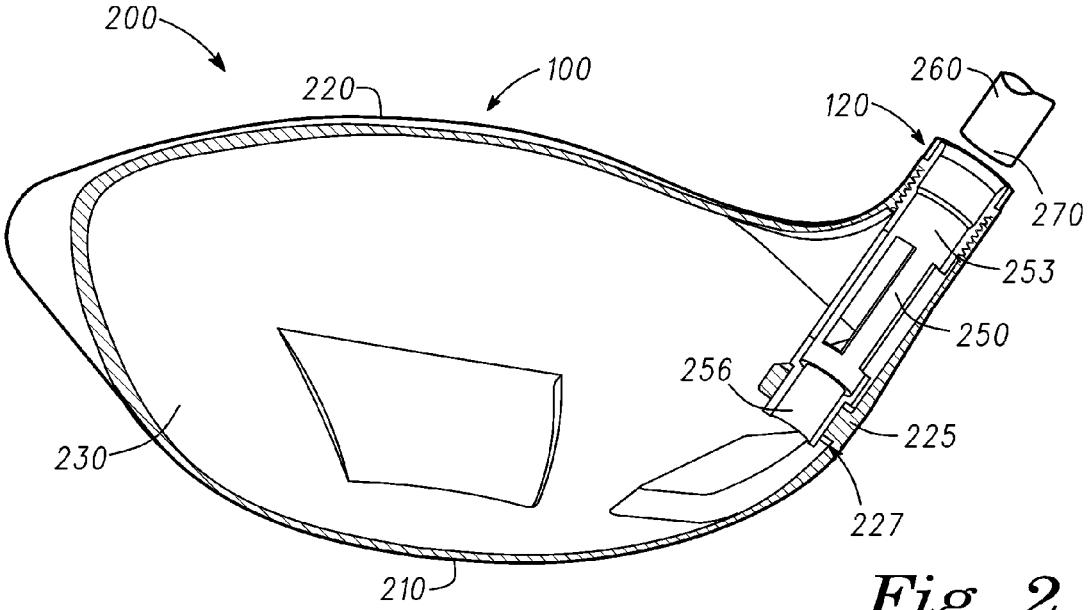
FIG. 2 is a front cross sectional view of a golf club head taken along section line 2-2 according to one embodiment of the apparatus, methods, and articles of manufacture described herein.

FIG. 2 shows a cross section of a golf club 200 that can comprise golf club head 100 depicted in FIG. 1, where the cross section is taken along section line 2-2 in FIG. 1. Golf club 200 is merely exemplary and is not limited to the embodiments presented herein. Golf club 200 can be employed in many different embodiments or examples not specifically depicted or described herein.

Golf club 200 is comprised of golf club head 100 and shaft 260. In FIG. 2, shaft 260 is shown disassembled from golf club head 100. Golf club head 100 is shown to include a sole portion 210, a crown portion 220, an interior surface 230, a support structure 225, and a hosel insert 250. (Hosel insert 250 and shaft 260 are not shown in FIG. 1.) Interior surface 230 defines an outer boundary of a hollow cavity within golf club head 100. Hole 120 can create a passage through interior surface 230 to the interior of golf club head 100. The location on golf club head 100 of hole 120 is not restricted by the embodiment in FIG. 2. Hole 120 can be located anywhere on golf club head 100, leading into the area encompassed by interior surface 230.

Hosel insert 250 is located within hole 120 of golf club head 100. Hosel insert 250 can receive shaft tip 270. Shaft tip 270 can be fixed to the hosel insert 250 by any one of welding, brazing, adhesion, or any mechanical, chemical, or other suitable attachment method. Hosel insert 250 is located in hole 120 to couple shaft 260 to golf club head 100.

Hosel insert 250 can comprise a sturdy material such as magnesium, plastic, composite, or any other suitable material. The material used to manufacture hosel 250 has a density. For example, when hosel 250 is made of magnesium, the magnesium can have a density of 1.73 g/cm$^3$ at room temperature. In other embodiments, these densities can be between approximately 1.0 g/cm$^3$ and approximately 2.8 g/cm$^3$. These densities for the materials of hosel 250 are generally less than the densities of titanium, aluminum, or steel, etc. used to manufacture the rest of golf club head 100. In general, materials with lower density, such as magnesium versus other metals, will have less mass for the same amount of volume. By manufacturing hosel 250 out of a material with a lower density than the other material of golf club head 100, mass can be reduced in the portion of the golf club head where shaft 260 is coupled to golf club head 100. The amount of mass reduced in this portion of golf club head 100 can be added advantageously in other parts of golf club head 100.

In general, hosel insert 250 is located in hole 120 and extends to support structure 225. Hosel insert 250 can be fixed to either hole 120 or support structure 225, or hosel insert 250 can be fixed to both of hole 120 and support structure 225. The fixing methods can be mechanical, chemical, welding, brazing, etc., as described above.

Support structure 225 is located at interior surface 230 of golf club head 100, and is aligned with hole 120. Support structure 225 can comprise a boss-like structure with a support structure bore 227 that is configured to receive hosel insert 250. In another embodiment, support structure 225 may not have support structure bore 227 so that the hosel insert abuts support structure 225.

In one embodiment, support structure 225 is located between hole 120 and sole portion 210. Support structure 225 can be coupled to interior surface 230 of golf club head 100 by any method. For example, support structure 225 can be coupled to interior surface 230 by welding, brazing, or adhering to interior surface 230, or support structure 225 can be cast with interior surface 230 such that support structure 225 and interior surface 230 are part of a single, integral piece of material. In the current embodiment, support structure 225 is approximately 0.75 inches (1.91 cm) from sole portion 210. However, support structure 225 can be located closer to crown portion 220 than shown in FIG. 2 or more distant from crown portion 220.

Hosel insert 250 can comprise a first hosel portion 253 and a second hosel portion 256. First hosel portion 253 is configured to receive, be received by, and/or be coupled to the tip of a shaft 270. The tip of shaft 270 can be fixed to first hosel portion 253 by any of an adhesive, a weld, a braze, or any mechanical or chemical fastening method. Second hosel portion 256 is adjacent to first hosel portion 253. Second hosel portion 256 is also adjacent shaft tip 270 when shaft tip 270 is received by first hosel portion 253.

Second hosel portion 256 is supported by support structure 225, and first hosel portion 253 may be supported by hole 120. As shown in FIG. 2, support structure 225 is not contiguous with hole 120 to reduce the mass of the structure used to support hosel insert 250. Hosel insert 250 is exposed within the interior cavity of golf club head 100.

Turning to the next figure, FIG. 3 shows a cross sectional view of the hosel region of golf club head 100. Hosel insert 250 substantially occupies hole 120 when placed in hole 120. Hole 120 has a hole cross section, and hosel insert 250 has at least one exterior hosel insert cross section that is substantially similar to hole 120 cross section. The exterior hosel insert cross section can be slightly smaller than the cross section of hole 120 to facilitate receiving hosel insert 250 into hole 120. In some embodiments, there can be a slight space between hosel insert 250 and the perimeter of hole 120 when hosel insert 250 is installed or located in hole 120. The space can be sealed with a filler material. As an example, the distance between the exterior of hosel insert 250 and hole 120 can be approximately 0.012 inches (0.03 cm) to 0.001 inches (0.003 cm).

Hosel insert 250 can be fixed in hole 120 using a mechanical, chemical, or other technique. For example, hole 120 can comprise the first part of a mechanical fastening mechanism. In FIG. 3, hole 120 can have a hole threaded portion 330 at its perimeter. Hole 120 also can comprise a slotted region for receiving a boss (not shown), or a notched area for receiving a pin (not shown). Hole threaded portion 330 shown in FIG. 3 can have any number of threads of any thickness. Hosel insert 250 can have a second, complimentary mechanical fastening mechanism. For example, hosel insert 250 can have a complimentary hosel threaded portion 340 as shown in the FIG. 3 embodiment, or hosel insert 250 can have a boss (not shown) or a pin (not shown). When hosel insert 250 is placed in hole 120, hole threaded portion 330 will receive hosel threaded portion 340 as hosel insert 250 is rotated into position. The mechanical fixing method can be permanent or reversible.

Other methods of fixing hosel insert 250 into hole 120 can be used in addition to, or in place of, the mechanical methods. For example, hosel insert 250 can be fixed to hole 120 by a welding method. In another example, hosel insert 250 can be fixed to hole 120 by brazing. In a further example, an adhesive or epoxy could be used to fix hosel insert 250 to hole 120. Additionally, any of welding, brazing or adhesive could be used in conjunction with any of the mechanical fixing methods described above. Any of the fixing methods can be applied at first hosel region 253 and/or second hosel region 256.

Hosel insert 250 can comprise a hosel end 360, which can comprise a hosel flange 370. Interior surface 230 of golf club head 100 can create a periphery around hole 120 that can be adjacent to hosel flange 370 when hosel insert 250 is located in hole 120. Hosel flange 370 can assist in sealing hole 120 when hosel insert 250 is installed, can act as a stopping mechanism for the mechanical fastener, and/or can create more bonding surface area for a weld, braze or adhesive. Accordingly, hosel flange 370 can have an exterior diameter that is larger than the diameter of hole 120, and hosel flange 370 can be located outside of hole 120.

In FIG. 4, hosel insert 250 is shown to comprise hosel end 360 and mechanical fastening portion 340. The mechanical fastening portion 340 of hosel insert 250 is depicted as threads proximate to hosel end 360. As indicated above, however, mechanical fastening portion 340 can comprise other features such as pins, bosses, or notches, and mechanical fastening portion 340 can be located anywhere along hosel insert 250. Hosel end 360 further comprises a tooled portion 420 for engaging a tool (not shown) in order to secure mechanical fastening portion 340 to hole 120 (FIG. 3) of golf club head 100 (FIG. 3).

In FIG. 4, tooled portion 420 of hosel insert 250 comprises notches 430 proximate to hosel end 360. Notches 430 are configured to receive a tool (not shown), and then facilitate the engagement of mechanical fastening portion 340 to hole 120 (FIG. 3) to fix hosel insert 250 into golf club head 100 (FIG. 3). Notches 430 can be of any configuration, and can be placed anywhere along hosel insert 250. For example, notches 430 can be located proximate hosel end 360, as shown in FIG. 4, and separate from mechanical fastening portion 340. In a different embodiment, notches 430 can be replaced with a single hexagon or other shape depression, and/or notches 430 can be located on an interior surface of hosel insert 250 (not shown).

Hosel insert 250 has a hosel length 460. Hosel length 460 can be between approximately 0.25 inches (0.64 cm) and approximately 3.0 inches (7.62 cm). In a different embodiment, hosel length 460 is between approximately 0.5 inches (1.27 cm) to approximately 2.0 inches (5.08 cm). Depending on the golf club head being manufactured, hosel length 460 can be any suitable length for hosel insert 250. Factors influencing hosel length 460 are the material being used to manufacture hosel insert 250, the type of golf club head being manufactured, other dimensions of hosel insert 250, and/or the method being used to fix hosel insert 250 to the golf club head.

Hosel insert 250 also has at least one hosel outside diameter 470. Hosel outside diameter 470 can be substantially the same as the diameter of hole 120 configured to support hosel insert 250. For example, hosel outside diameter 470 can be between approximately 0.25 inches (0.64 cm) and approximately 0.75 inches (1.91 cm). In a different embodiment, hosel outside diameter 470 can be between approximately 0.25 inches (0.64 cm) to approximately 0.5 inches (1.27 cm) and/or between approximately 0.4 inches (1.02 cm) and approximately 0.6 inches (1.52 cm). Hosel insert 250 is, according to one embodiment, comprised of more than one hosel outside diameter 470. In other embodiments, hosel outside diameter 470 can stay constant throughout hosel length 460.

Hosel insert 250 can comprise any suitable material that has a lower density than the golf club head (e.g., golf club head 100) that is configured to receive hosel insert 250. The material used to manufacture hosel insert 250 also can have a damping capacity associated with it. The damping capacity of a material defines the ability of the material to absorb vibrations and not transmit the vibrations through the material. The damping capacity is given in a percentage that correlates to a percentage of vibrational energy not transferred through a material. For example, a magnesium alloy can have a damping capacity of 5.33 percent (%) when a predetermined vibrational energy is applied, but cast iron can have a damping capacity of 5.0% and aluminum alloy can have a damping capacity of 0.51% when the same vibrational energy is applied. Hosel insert 250 can comprise a material that is associated with a relatively lower damping factor or capacity when compared to the other material(s) used to manufacture the other parts of the golf club head, as described above. The lower damping factor or capacity of hosel insert 250 can create a better feel of the golf club when contacting a golf ball as well as prolong the structural integrity of the golf club head by damping the vibrations resulting from striking the golf ball.

Hosel insert 250 can have openings or voids 490 in non-end portions of the sidewall of hosel surface 480. Voids 490 can facilitate mass removal from hosel insert 250 without compromising the structural integrity of hosel insert 250. Voids 490 can be rectangular as shown in FIG. 4, or voids 490 can have an elliptical shape or any polygon or closed curve configuration. Voids 490 can comprise any combination of the aforementioned void configurations. Voids 490 can be located centrally along hosel length 460 or off-centered along length 460. The quantity of voids and their arrangement in hosel insert 250 can vary from one hosel insert to another. In another embodiment (not shown) hosel insert 250 can be free from any voids in surface 480 at the side wall of hosel insert 250.

Figure 5:
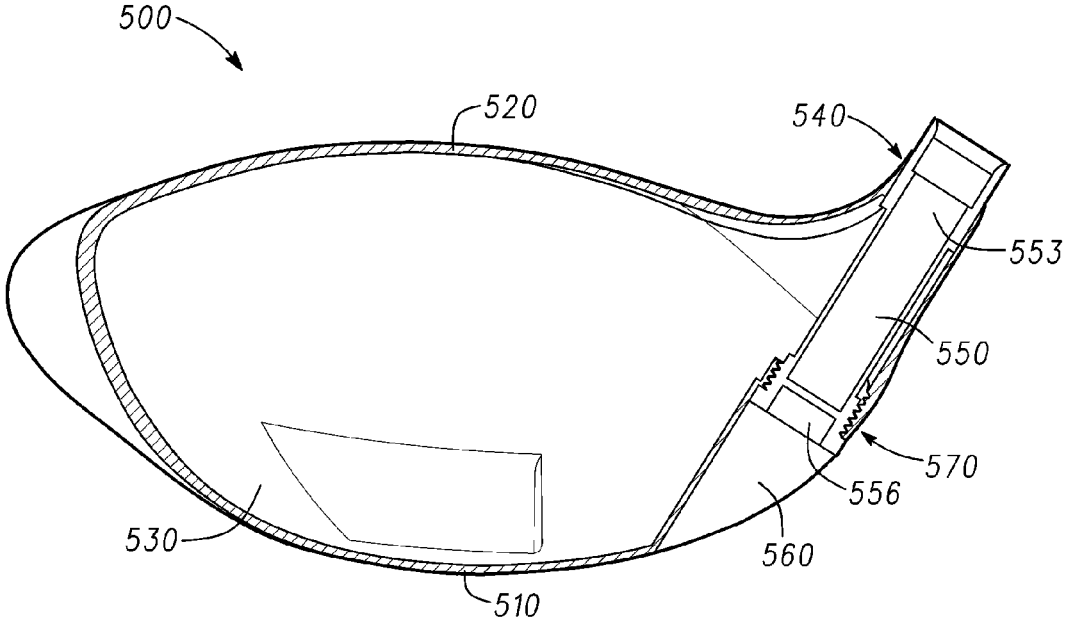
FIG. 5 is a front cross sectional view of a golf club head according to another embodiment of the apparatus, methods, and articles of manufacture described herein.

Referring to FIG. 5, a cross sectional view of a golf club head 500 is shown according to another embodiment. Golf club head 500 is merely exemplary and is not limited to the embodiments presented herein. Golf club head 500 can be employed in many different embodiments or examples not specifically depicted or described herein. Golf club head 500 can be similar to golf club head 100.

Golf club head 500 has a sole portion 510, a crown portion 520, an interior surface 530, a crown hole 540, a hosel insert 550, and a support structure 560. Like the above examples, hosel insert 550 can be located in crown hole 540. Hosel insert 550 can comprise a first hosel portion 553 and a second hosel portion 556. First hosel portion 553 can be supported by crown hole 540, and second hosel portion 556 can be supported by support structure 560. At least one of first hosel portion 553 or second hosel portion 556 is fixed to at least one of crown hole 540 or support structure 560, respectively, using one or more of the fixing methods discussed herein. Hosel insert 550 can have or be devoid of voids (similar to voids 490 in FIG. 4). Also, hosel insert 550 can be exposed inside of golf club head 500.

Support structure 560 comprises a second hole 570 that passes through interior surface 530. Second hole 570 is aligned to crown hole 540 and is located between crown portion 520 and sole portion 510 of golf club head 500. Second hole 570 can be a distance between approximately 0.25 inches (0.64 cm) and approximately 1.5 inches (3.81 cm) from sole portion 510. In one embodiment, second hole 570 can be a distance of approximately 0.75 inches (1.91 cm) from sole portion 510. Second hosel portion 556 can be fixed to second hole 570 by any mechanical, chemical, welding, or brazing, or adhering techniques.

Figure 6:
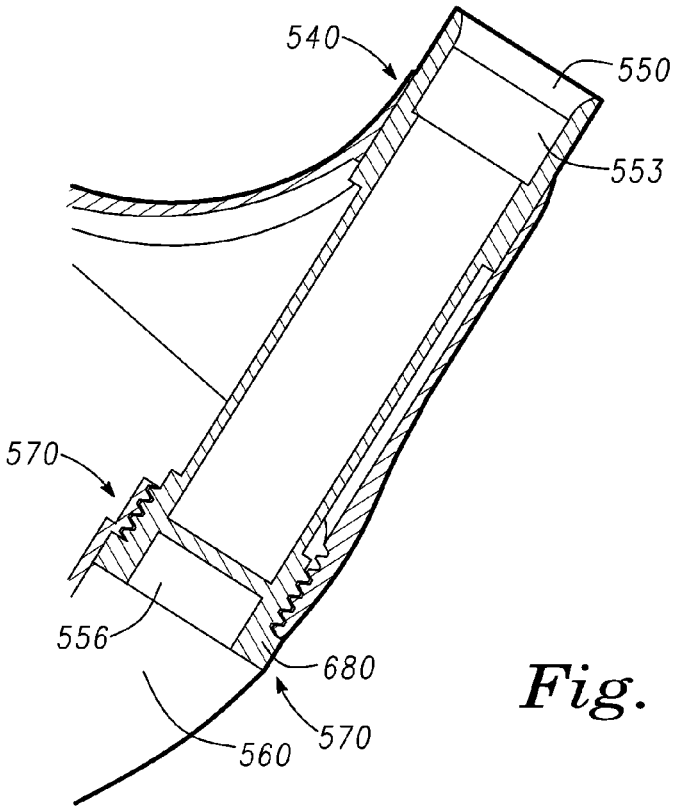
FIG. 6 is a cross sectional view of a hosel region of the golf club head of FIG. 5.

Referring to FIG. 6, a cross sectional view of the hosel region of FIG. 5 is shown. First hosel portion 553 is supported by crown hole 540, and second hosel portion 556 is supported by support structure 560. Second hosel portion 556 can comprise a hosel flange 680 that is adjacent to interior surface 530 and that has an exterior diameter larger than the diameter of second hole 570. Hosel insert 550 can be inserted into second hole 570 until hosel flange 680 abuts second hole 570. Similar to the above embodiments, hosel flange 680 can assist in sealing second hole 570, or hosel flange 680 can act as a stopping mechanism for a mechanical fastener, or hosel flange 680 can create more bonding surface area for a weld, braze or adhesive.

Second hole 570 can comprise any shaped cross section. Second hosel portion 556 can comprise a complimentary cross section such that second hole 570 can be substantially filled by second hosel portion 556. Crown hole 540 and second hole 570 can have the same cross sectional shape and size, and first hosel portion 553 and second hosel portion 556 can have the same cross sectional shape and size. First hosel portion 553 can have a cross section that compliments the cross section of crown hole 540, and second hosel portion 556 can have a cross section that compliments the cross section of second hole 570.

Figure 7:
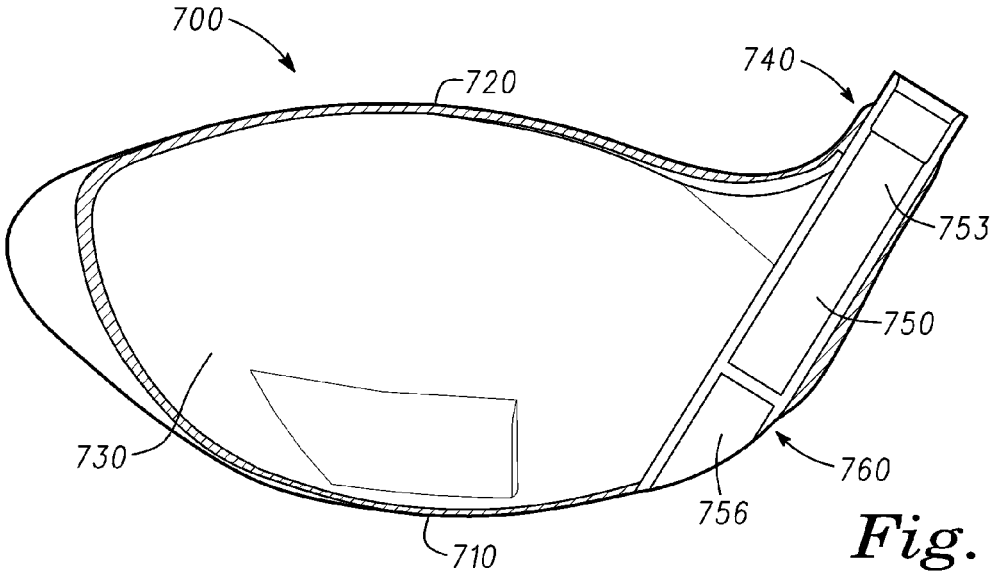
FIG. 7 is a front cross sectional view of a golf club head according to another embodiment of the apparatus, methods, and articles of manufacture described herein.

Turning to FIG. 7, a front cross sectional view of a golf club head 700 is shown according to another embodiment. Golf club head 700 is merely exemplary and is not limited to the embodiments presented herein. Golf club head 700 can be employed in many different embodiments or examples not specifically depicted or described herein. Golf club head 700 can be similar to either of golf club heads 100 (FIGS. 1-3), and/or 500 (FIGS. 5-6).

Golf club head 700 has a sole portion 710, a crown portion 720, an interior surface 730, a crown hole 740, a hosel insert 750, and a sole hole 760. Crown hole 740 and sole hole 760 are passages through interior surface 730 of golf club head 700. Sole hole 760 is aligned with crown hole 740.

Hosel insert 750 is comprised of a first hosel portion 753 and a second hosel portion 756. First hosel portion 753 is configured to receive a shaft tip (not shown), and is supported by crown hole 740. Second hosel portion 756 is adjacent to first hosel portion 753 and the shaft tip (not shown), and is supported by sole hole 760. At least one of first hosel portion 753 or second hosel portion 756 is fixed by one of welding, adhering, brazing, or mechanically fixing to one of crown hole 740 or sole hole 760, respectively. Hosel insert 750 can be exposed inside of golf club head 700.

Figure 8:
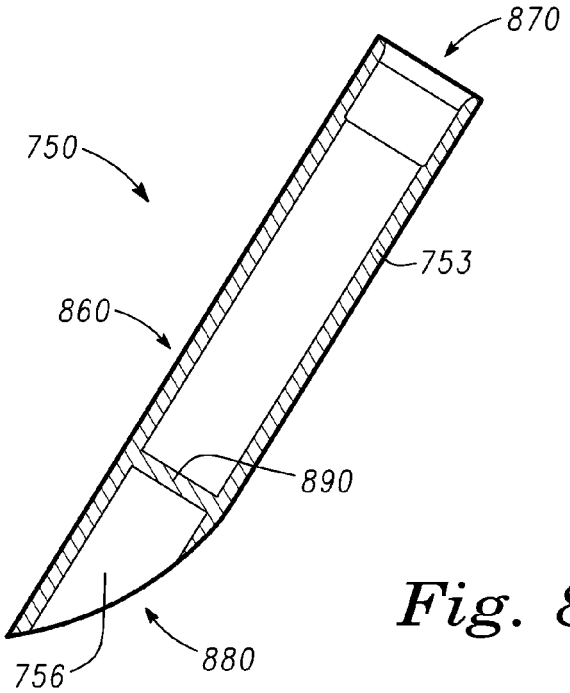
FIG. 8 is a cross sectional view of a hosel insert according to the embodiment of FIG. 7.

FIG. 8 is a cross sectional view of hosel insert 750. Hosel insert 750 can comprise a hollow tubular body 860, a first hosel end 870, a second hosel end 880, and a barrier 890. When placed in golf club head 700 (FIG. 7), first hosel end 870 is proximate crown hole 740 (FIG. 7) of golf club head 700 (FIG. 7), and second hosel end 780 is proximate sole hole 760 (FIG. 7) of golf club head 700 (FIG. 7). Barrier 890 can be located between first hosel end 870 and second hosel end 880. Barrier 890 can abut the shaft tip (not shown) when first hosel portion 753 receives the shaft tip. Additionally, barrier 890 can separate and/or isolate first hosel portion 753 from second hosel portion 756. Hosel insert 750 can have or be devoid of voids (similar to voids 490 in FIG. 4).

Figure 9:
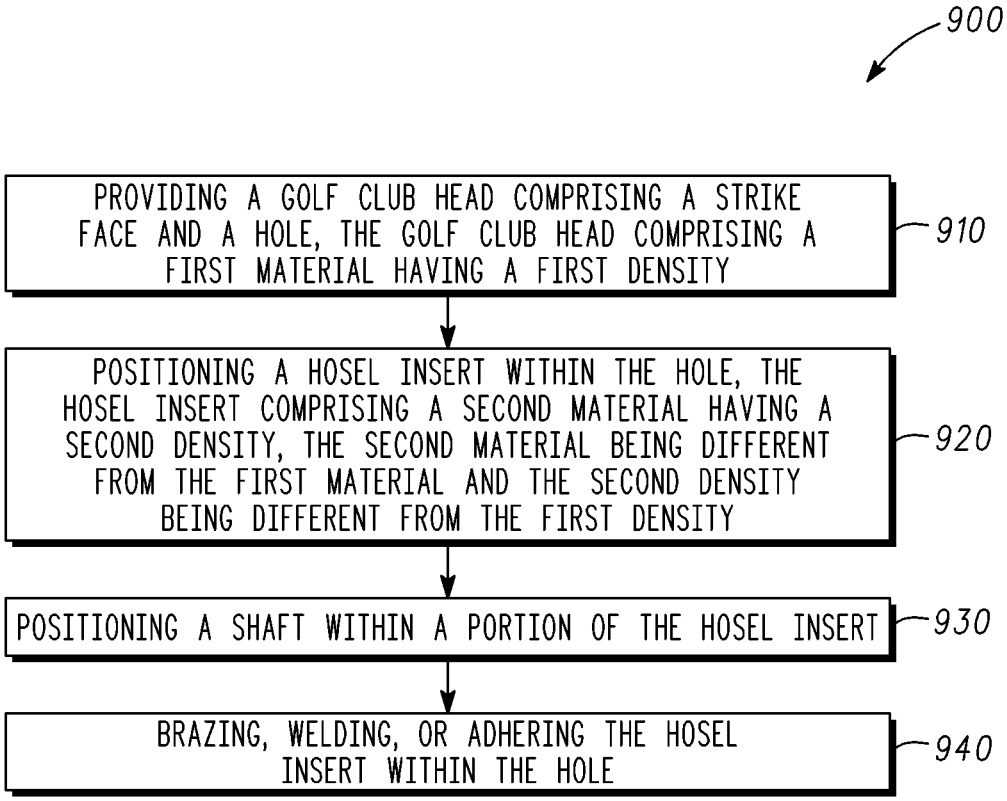
FIG. 9 is a flowchart of a method according to another embodiment.

FIG. 9 illustrates a flowchart for a method 900, which can be used to provide, form, and/or manufacture a golf club head with a hosel insert in accordance with the present disclosure. In some examples, the golf club head with a hosel insert can be similar to the golf club heads and hosel inserts of FIGS. 1-8.

Method 900 can include a block 910 of providing a golf club head comprising a strike face and a hole. The golf club head can comprise a first material having a first density. As an example, the golf club head of block 1310 can be similar to one or more of golf club heads 100 (FIGS. 1-3), 500 (FIGS. 5-6), 700 (FIGS. 7-8).

Method 900 also can include a block 920 of positioning a hosel insert within the hole. The hosel insert can comprise a second material having a second density, where the second material is different form the first material and where the second density is different from the first density. In some embodiments, the second density can be less than the first density. As an example, the hosel insert of block 920 can be similar to one or more of hosel inserts 250 (FIGS. 2-4,), 550 (FIG. 5), 750 (FIGS. 7-8).

Method 900 can further include a block 930 for positioning a shaft within a portion of the hosel insert. As an example, the shaft of block 930 can be similar to shaft 260 (FIG. 2). Block 930 can occur before, after, or simultaneously with block 920.

Method 900 can additionally include a block 940 for at least one of brazing, welding, or adhering the hosel insert within the hole. Block 940 can occur after or simultaneously with block 930.

In some examples, one or more of the different blocks of method 900 can be combined into a single block or performed simultaneously, and/or the sequence of such blocks can be changed. In the same or other examples, some of the blocks of method 900 can be subdivided into several sub-blocks. There can also be examples where method 900 can comprise further or different blocks. In addition, there can be examples where method 900 can comprise only part of the steps described above. For instance, block 940 can be optional in some implementations. Other variations can be implemented for method 900 without departing from the scope of the present disclosure.

The various embodiments recited herein provide for a relatively less dense hosel insert compared with the rest of the golf club head. These embodiments allow less mass to be used at a hosel region that maintains the proper structure for coupling a golf club head to a shaft. The mass that is saved from the hosel insert region can be used to optimize the moment of inertia of the golf club head, to optimize the center of gravity placement of the golf club head, to strengthen the strike face of the golf club head, to shift the swing weight of the golf club, and/or to modify the shape of the golf club head.

Although golf club heads with hosel inserts and related methods have been described with reference to specific embodiments, various changes may be made without departing from the scope of the present disclosure. As an example, different features of hosel inserts 250 (FIGS. 2-4), 550 (FIG. 5), 750 (FIGS. 7-8) can be combined together in other hosel inserts. Examples of some of such combinations and other variations have been given in the foregoing description. Other permutations of the different embodiments having one or more of the features of the various figures are likewise contemplated. Accordingly, the specification, claims, and drawings herein are intended to be illustrative of the scope of the disclosure and are not intended to be limiting. It is intended that the scope of shall be limited only to the extent required by the appended claims.

Similarly, all elements claimed in any particular claim are essential to the embodiment claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a wood-type golf club, the apparatus, methods, and articles of manufacture described herein may be applicable to other types of golf club such as a hybrid-type golf club, an iron-type golf club, a wedge-type golf club, and/or a putter-type golf club. In other embodiments, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A golf club comprising:

a golf club head comprising:

a hollow body comprising a first material having a first density and further comprising:

a strike face;

a crown coupled to the strike face comprising a crown hole opening into an interior of the hollow body;

a sole coupled to the strike face;

an interior surface forming an outer boundary of the interior of the hollow body; and a support structure coupled to the interior surface and aligned with the crown hole;

a hosel insert comprising a first hosel portion configured to house a shaft tip and a second hosel portion adjacent to the first hosel portion; and a shaft comprising the shaft tip, the shaft tip located within the first hosel portion of the hosel insert;

wherein:

the hosel insert is located within the crown hole and comprises a second material having a second density;

the second material is different than the first material;

the second density is less than the first density;

the first hosel portion engages the crown hole;

the second hosel portion engages the support structure;

the strike face has an exterior strike face surface configured to strike a golf ball, and an interior strike face surface opposite the exterior strike face surface and forming a portion of the outer boundary of the interior of the hollow body; the support structure is a support structure boss coupled with the interior strike face surface and spaced between the sole and the crown hole; and the support structure comprises a second hole extending entirely through the support structure, the second hosel portion extends through the second hole, and the support structure supports the second hosel portion.

2. The golf club of claim 1, wherein:

the first density is approximately 4.5 g/cm$^3$; and the second density is approximately 1.7 g/cm$^3$.

3. The golf club of claim 1, wherein:

the crown hole comprises a crown hole cross section;

the hosel insert comprises at least one hosel insert exterior cross section; and the crown hole cross section and the at least one hosel insert exterior cross section are substantially the same shape.

4. The golf club of claim 1, wherein:

the crown hole comprises a first part of a two part mechanical fastener;

the hosel insert comprises a second part of the two part mechanical fastener; and the first part is complementary to the second part.

5. The golf club of claim 1, wherein:

the hosel insert comprises a hosel tip located proximate to the crown hole; and the hosel tip is configured to engage a tool to secure the hosel tip to the crown hole.

6. The golf club of claim 1, wherein:

the crown hole comprises a crown hole diameter between approximately 0.75 inches and approximately 0.25 inches; and the hosel insert comprises at least a first hosel outside diameter between approximately 0.75 inches and approximately 0.25 inches.

7. The golf club of claim 1, wherein:

the hosel insert comprises a length between approximately 0.25 inches and approximately 3.0 inches.

8. The golf club of claim 1, wherein:

the hosel insert comprises at least one opening at a non-end portion of a sidewall of the hosel insert.

9. The golf club of claim 1, wherein:
the first density is between approximately 2.6 g/cm$^3$ and approximately 7.8 g/cm$^3$; and
the second density is between approximately 1.0 g/cm$^3$ and approximately 2.8 g/cm$^3$.

10. The golf club of claim 1, wherein:
the strike face comprises titanium; and
the hosel insert comprises magnesium.

11. The golf club of claim 1, wherein:
the first material has a first dampening capacity;
the second material has a second dampening capacity; and
the first dampening capacity is less than the second dampening capacity.

12. A golf club head comprising:
a hollow body comprising a first material and further comprising:
a strike face;
a crown coupled to the strike face and comprising a crown hole opening into an interior of the hollow body;
a sole coupled to the strike face;
an interior surface forming an outer boundary of the interior of the hollow body; and
a support structure coupled to the interior surface and aligned with the crown hole; and
a hosel insert comprising a first hosel portion configured to house a shaft tip and a second hosel portion adjacent to the first hosel portion;
wherein:
the first hosel portion engages the crown hole;
the second hosel portion engages the support structure;
the hosel insert comprises a second material different from the first material;
the strike face has an exterior strike face surface configured to strike a golf ball, and an interior strike face surface opposite the exterior strike face surface and forming a portion of the outer boundary of the interior of the hollow body;
the support structure is a support structure boss coupled with the interior strike face surface and spaced between the sole and the crown hole; and
the support structure comprises a second hole extending entirely through the support structure, the second hosel portion extends through the second hole, and the support structure supports the second hosel portion.

13. The golf club head of claim 12 wherein:
the second material comprises a lower density than the first material.

14. The golf club head of claim 12, wherein:
the second hosel portion comprises a substantially circular cross section; and
the support structure comprises a complementary circular shape.

15. The golf club head of claim 12, wherein:
the first hosel portion comprises a first part of a two part mechanical fastener;
the crown hole comprises a second part of the two part mechanical fastener; and
the second part is complementary to the first part.

16. The golf club head of claim 12, wherein:
the first hosel portion further comprises a hosel end configured to engage a tool for securing the first hosel portion to the crown hole.

17. The golf club head of claim 12, wherein:
at least one of a braze, a weld, or an adhesive fixes the first hosel portion to the crown hole.

18. The golf club head of claim 12, wherein:
a non-end portion of a sidewall of the first hosel portion of the hosel insert comprises at least one opening to reduce a mass of the hosel insert.

19. The golf club head of claim 12, wherein:
the first hosel portion has an exterior first hosel portion adjacent to the outer boundary of the interior of the hollow body; and
the exterior first hosel portion comprises a flange, the flange engaging the crown hole.

20. The golf club head of claim 12, wherein:
the hosel comprises a hollow tubular body, a first hosel end proximate the first hosel portion, and a second hosel end proximate the second hosel portion; and
a barrier within the hollow tubular body between the first hosel end and the second hosel end.

21. The golf club head of claim 12, wherein:
the second hosel portion is received by the support structure approximately 0.75 inches above the sole.

22. A method for providing a golf club, the method comprising:
providing a golf club head comprising:
a hollow body comprising a first material having a first density and further comprising:
a strike face;
a crown coupled to the strike face comprising a crown hole opening into an interior of the hollow body;
a sole coupled to the strike face;
an interior surface forming an outer boundary of the interior of the hollow body; and
a support structure coupled to the interior surface and aligned with the crown hole;
positioning a hosel insert within the crown hole, the hosel insert comprising a first hosel portion configured to house a shaft tip of a shaft and a second hosel portion adjacent to the first hosel portion; and
positioning the shaft tip within the first hosel portion of the hosel insert;
wherein:
the hosel insert comprises a second material having a second density;
the second material is different than the first material; and
when the hosel insert is positioned in the crown hole:
the first hosel portion engages
the second hosel portion engages the support structure; the strike face has an exterior strike face surface configured to strike a golf ball, and an interior strike face surface opposite the exterior strike face surface and forming a portion of the outer boundary of the interior of the hollow body; the support structure is a support structure boss coupled with the interior strike face surface and spaced between the sole and the crown hole; and the support structure comprises a second hole extending entirely through the support structure, the second hosel portion extends through the second hole, and the support structure supports the second hosel portion.

23. The method of claim 22, wherein:
the second density is less than the first density.

24. The method of claim 22, wherein:
at least one of a braze, a weld, or an adhesive fixes the hosel insert within the crown hole.

* * * * *